US005188013A

United States Patent [19]

Cardinale

[11] Patent Number: 5,188,013

[45] Date of Patent: Feb. 23, 1993

[54] VINYL TILE MEASURING AND CUTTING DEVICE

[76] Inventor: Douglas Cardinale, 6 Intervale Ter., Randolph, Mass. 02368

[21] Appl. No.: 754,508

[22] Filed: Sep. 3, 1991

[51] Int. Cl.[5] ..... B28D 1/22

[52] U.S. Cl. ..... 83/879; 83/468; 83/170; 33/527; 33/DIG. 20

[58] Field of Search ..... 83/879, 468, 468.1, 83/468.2, 468.3, 468.4, 522.19, 170; 125/23.01, 23.02; 33/518, 526, 527, DIG.20, 32.1, 32.2

[56] References Cited

U.S. PATENT DOCUMENTS

| | | | |
|---|---|---|---|
| 2,185,985 | 1/1940 | Lund | 83/468 |
| 2,619,173 | 11/1952 | Crain | 83/701 |
| 2,622,680 | 12/1952 | Yakubik | 83/15 |
| 4,827,625 | 5/1989 | Le Moal | 33/DIG. 20 |
| 4,860,723 | 8/1989 | Fortin | 83/879 |
| 5,038,490 | 8/1991 | Armstrong | 33/527 |

FOREIGN PATENT DOCUMENTS

| | | | |
|---|---|---|---|
| 2218375 | 11/1989 | United Kingdom | 125/23.02 |

*Primary Examiner*—Frank T. Yost
*Assistant Examiner*—Allan M. Schrock
*Attorney, Agent, or Firm*—William Nitkin

[57] ABSTRACT

A vinyl tile spacing gauge and cutter for the measuring and scoring of an edge floor tile, such device having a heated plate surface on which the tile is positioned and a pair of extendable measuring arms adapted to extend from the base of the device from the edge of a central flooring tile to an adjacent wall to determine the dimensions to cut the tile and a scoring arm positioned above the heated surface slideably adjustable to cut the tile at a selected position, such heated surface having a measurement grid delineated thereon for the positioning of a tile in relation thereto and in relation to the dimensions obtained from the measuring arms.

2 Claims, 3 Drawing Sheets

VINYL TILE MEASURING AND CUTTING DEVICE

BACKGROUND OF THE INVENTION

1. Field of the Invention

The device of this invention resides in the area of devices for the cutting of floor tiles and more particularly relates to a device for the heating and scoring of vinyl tiles to a particular shape for later installation.

2. Description of the Prior Art

It has long been appreciated by installers of floor tiles that when floor tiles are positioned along the outer perimeter of a floor where the tiles meet the walls, the individual edge tiles must often be cut down in size. Further the arrangement of the tiles installed within the central area of the floor in some cases does not align itself perfectly to the surrounding walls so that the outer edge tiles can be non-rectangular in shape due to the angles of the walls to the central layout of the floor tiles. The fact that outer floor edge tiles along the outer perimeter of the floor must be cut to fit has been addressed by devices utilized for the measurement of these tiles. For example, in U.S. Pat. No. 2,619,173 to Crane a device is disclosed having a pair of rods extending therefrom moving an attached flange which guides the tile under a cutter and adjusts the positioning of the tile to be cut at the appropriate angle to the wall, thereby enabling the tile to be cut to such size and alignment so as to fit in its designated space. A similar device to the Crane device is disclosed in U.S. Pat. No. 4,860,723 to Fortin, being a tile-cutting device with gauge arms which extend to the wall, which arms also help space a cutter above a tile for the proper size cut. Both of these prior art patents operate on ceramic-type tiles, and it should be noted that the device of this invention is specifically designed to operate on vinyl tiles which have unique cutting requirements in that vinyl tiles cannot be easily cut unless they are first heated. Currently to successfully cut vinyl tile or to bend it in any way, the tile must be first heated with a torch which heating is dangerous, inconvenient and time-consuming.

SUMMARY OF THE INVENTION

It is an object of this invention to provide a tile-measuring and scoring device especially designed for the cutting of vinyl tiles. The dimensions of such vinyl tiles, usually being the outer floor edge tiles, is determined by measurements made by using the device of this invention.

It is a further object of this invention to provide a warming plate on its tile scoring surface with a ruled gridwork on such warming plate surface. A scriber which is movable on a bar is adapted to be moved across the tile to scribe a cut where the heated tile can later be bent and broken by snapping the edges together to break the tile along such scored cut. The device of this invention includes a pair of measuring arms which extend from an opening in the side of the device over to the wall. The edge of the device is aligned with the edge of the already laid tiles on the floor while the arms are extended over to the wall, such arms including a measuring scale, such as in inches, positioned on the top of the arms so that when the arms are positioned against the wall, the arms' extension measurements can be determined by observation from above. These measurements may be different if the wall is not perfectly parallel to the appropriate side edge of the centrally installed tiles. When such arm measurements are different, the vinyl tile must be cut at an angle. To score a vinyl tile, one positions the tile face up on the heated tile warming plate on the device's base, and the scriber is moved across the tile, scoring it, such scriber moving along a laterally positioned slide member which can be adjusted in depth from the edge of the device. If the tile is not going to be perfectly rectangular, there is a scaled measurement grid on the heated plate, usually marked in inches, and the tile can be moved so that it is aligned on the grid in a complementary position to the measurements taken from the measuring arms such that the tile is then disposed at the appropriate angle and distance from the edge under the scriber. When scribed, the tile, at the same time also being heated, can be easily snapped in two after such scribing at the exact angular cut as determined by the measuring arms. The device of this invention can further include a storage tray compartment and other features as will be described further below.

DESCRIPTION OF THE PREFERRED EMBODIMENT(S)

Figure 1:
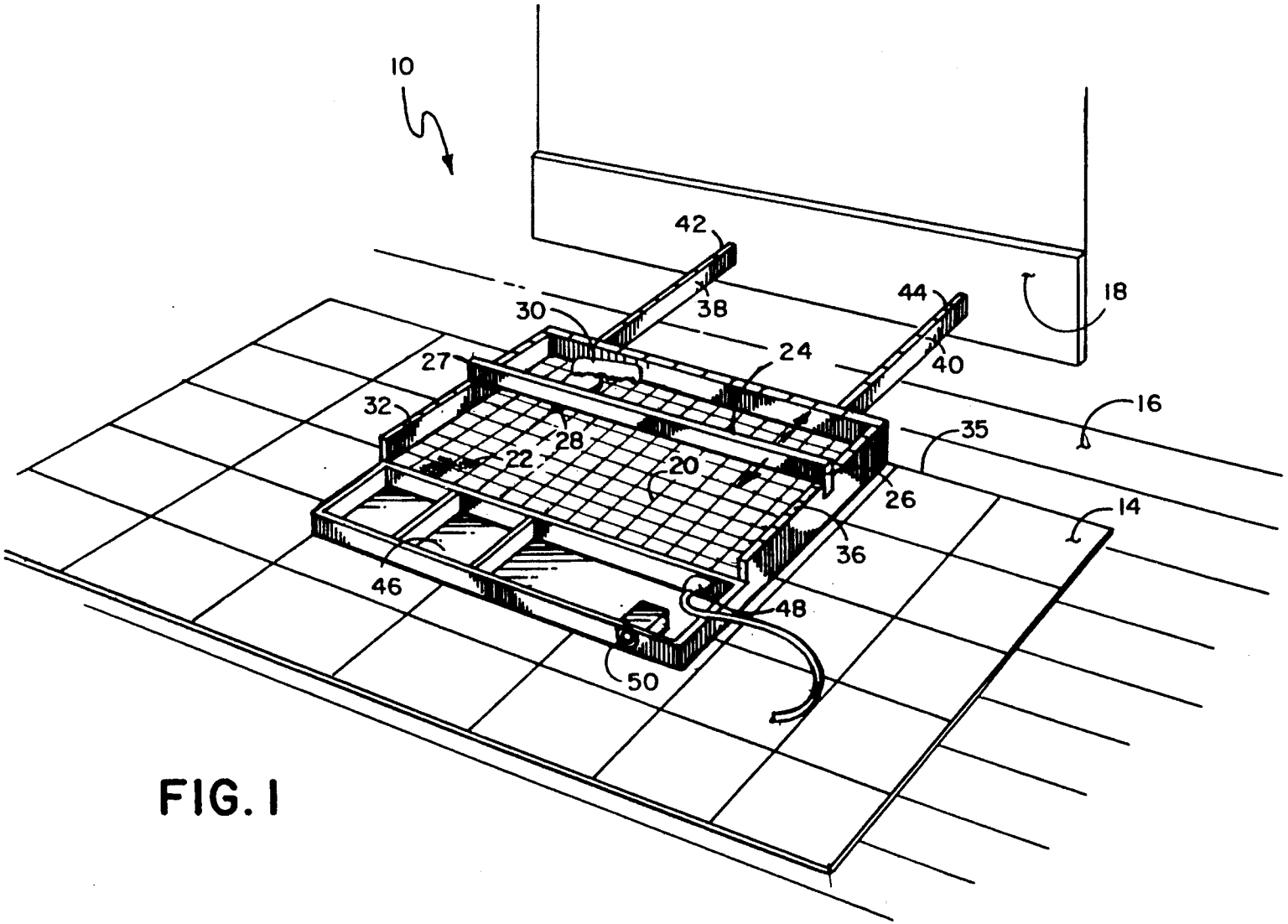
FIG. 1 illustrates a perspective view of the device of this invention.
Figure 2:
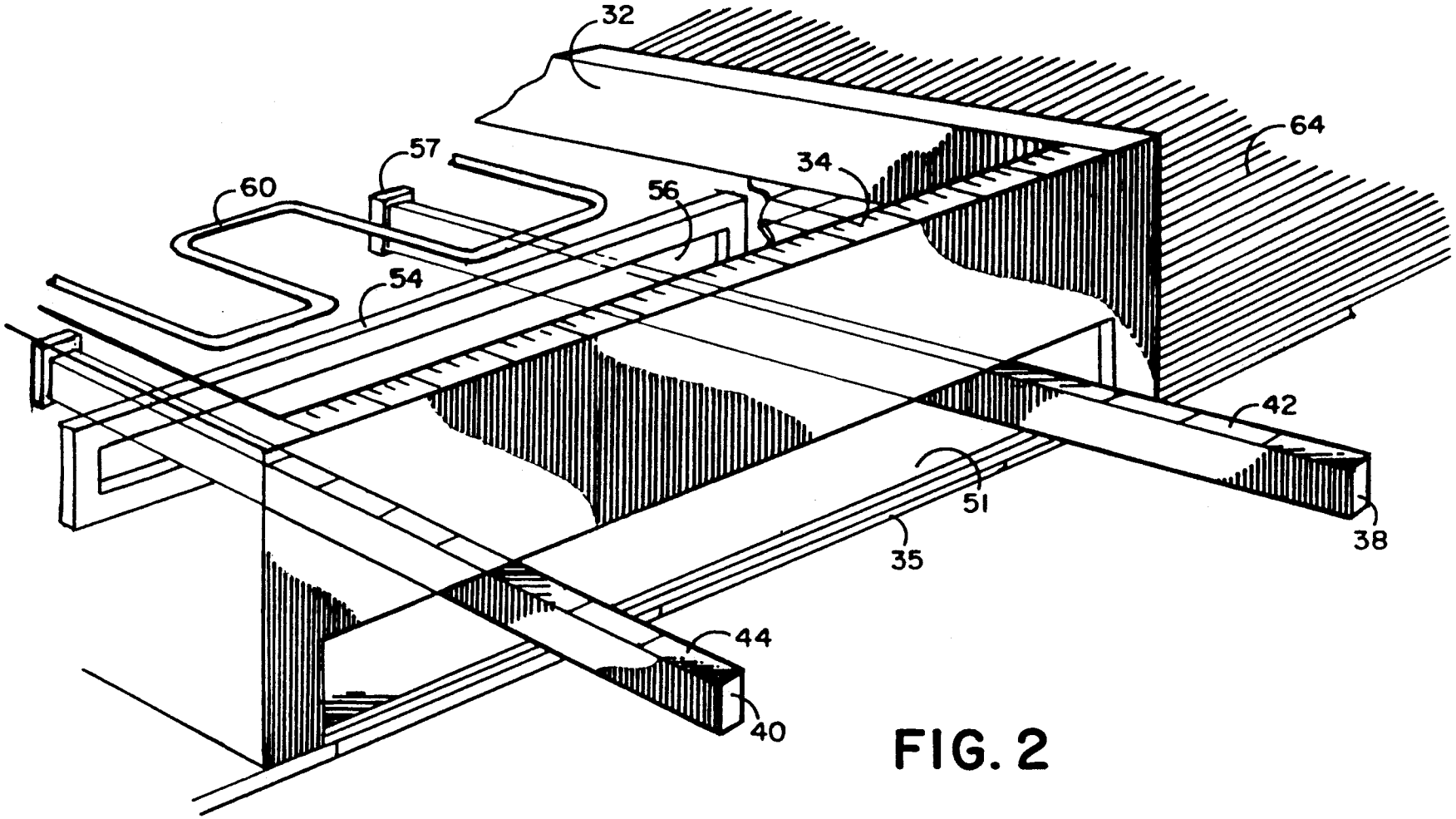
FIG. 2 illustrates a perspective view of a section of the device of this invention with the measuring arms enlarged and a portion of the top of the device cut away to show the internal structure of the device.
Figure 3:
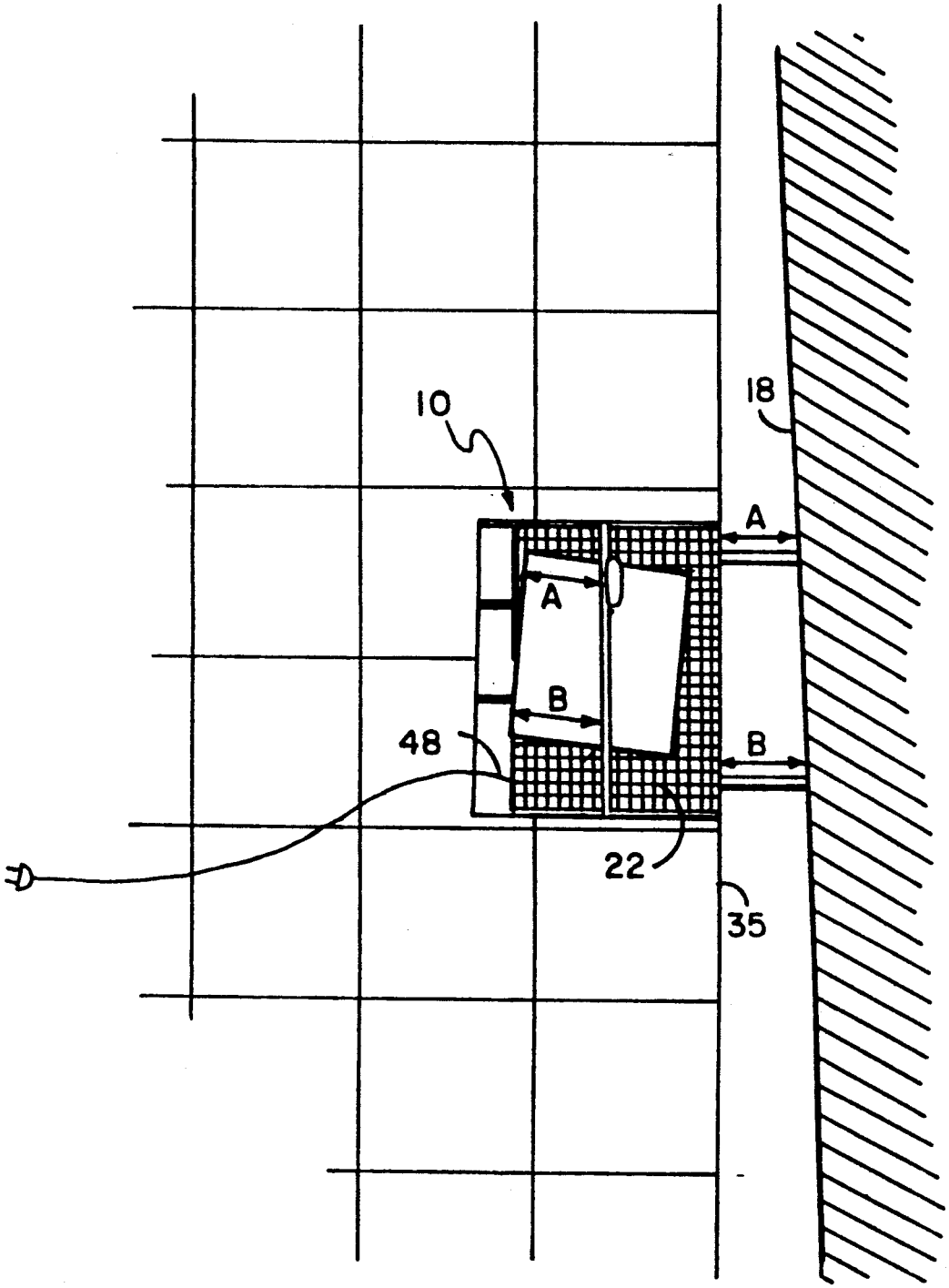
FIG. 3 illustrates a top view of a tile on the heated plate aligned at an angle under the scriber arm bar.

FIG. 1 illustrates the vinyl tile measuring and cutting device 10 of this invention which is seen positioned on floor 12 having a plurality of vinyl tiles 14 thereon. The inner edge 37 of the device of this invention is aligned with edges 35 of floor tiles 14, and first and second measuring arms 38 and 40, respectively, are pulled outward from the base 15 of the device to contact wall 18. As can be seen in FIG. 1, frequently floor tile edges 35 adjacent to the wall may be at a slight angle to the wall so that first and second measuring arms 38 and 40 may extend out to different distances to meet wall 18. On the top of first and second measuring arms 38 and 40 are, respectively, first and second ruler scales 42 and 44. These ruler scales can be marked in inches, starting at 1" nearest to the wall so that if one looks down from the top of the device along the inner edge 34 of device 10, one can read the length of the extension of each measuring arm to the wall. If the measuring arms extend the same distance, then the vinyl tile to be cut is rectangular. If the measuring arms show different distances, then the tile to be cut must be positioned at an angle under scriber bar 24. Scriber bar 24 is positioned over heated plate surface 20 and slides back and forth on vertically disposed first and second slideable adjusters 26 and 27. In a preferred embodiment heated plate surface 20 can be 12"×19" in size and marked off in a gridwork of inches and fractions thereof. Scriber handle 30 moves along scriber bar 24 and blade 28 extends thereunder. If the vinyl tile is to be cut in a rectangular shape, the tile can be positioned against front wall 34, and scriber bar 24 is slid parallel to the cutting line to the appropriate inch mark on left side wall 32 and right side wall 36, and the tile is then scribed at the proper distance. However, should the tile not be rectangular, a gridwork 22 of measurements which can be in inches, is disposed on heated plate surface 20, and the tile can be aligned under scriber bar 24 using measurements that match the measurements at one end extending from under bar 24 the same distance as first measuring arm 38 and at its other end the same distance as on second measuring arm 40 as seen in FIG. 3. Thus the tile is positioned somewhat at an angle on heated plate surface 20 under scriber bar 24 and cut at such appropriate angle. The tile must be heated sufficiently so that it will break apart when scored and snapped but should not be heated to a temperature at which the tile would melt, burn or become deformed. In this way the tile is heated and cut at the same time so that it can be snapped and easily positioned for installation. Power supply cord 48 extends to an electric outlet for electrical supply, and tray 46 can be provided to hold the various tools and implements used along with pencil sharpener 50 which items being conveniently located facilitate completion of the tile installation. Other items can be positioned on the device such as contour guide 64 seen in FIG. 2 comprised of a series of wires which can be positioned against an object and each wire depresses, as is well known in the art, a distance conforming to the object's shape so that the shape of the object against which the contour guide is pushed can be then traced onto the tile with a sharp pencil for later scoring of the tile with a knife when the tile is placed on the heated plate surface 20. Heated plate surface 20 can be made of metal as scribing blade 28 does not actually touch heated plate surface 20 but only cuts partially through the tile. Underneath heated plate surface 20 can be electrical coils 60 seen in FIG. 2 which provide heat to heated plate surface 20. Other equivalent heating means can be utilized to warm heated plate surface 20. First and second measuring arms 38 and 40 can be attached to bar 54 as seen in FIG. 2 with slot 56 defined therein and measuring arms 38 and 40 can be adjustable laterally and longitudinally within slot 56 to move them closer together or further apart as desired within arm opening 51 in base 15. First and second measuring arms 38 and 40 can move in and out within bar 54 and have first and second stop members 57 and 59 at the rear ends thereof, the rear ends being wider than the height of slot 56 to prevent the arms' removal from bar 54. Bar 54 is larger than arm opening 51 so that first and second measuring arms 38 and 40 will not fall out of the device of this invention. By allowing relatively free movement of the measuring arms back and forth and closer and further apart, the device can enable the tile (installer) to accomplish a variety of measurements to the adjoining wall surface so that each tile can be cut in conformity with actual measurements.

The use of the device of this invention reduces time spent installing vinyl tile and makes the installation of vinyl tile easier to accomplish compared with prior art methods as detailed above. The prior art process is slow and cumbersome and requires much equipment, including a torch, and makes the last portion of tile installation around the edges of a floor the most time-consuming portion of the entire job. With the use of the device of this invention, all tools and equipment are conveniently at hand in the tray and the heated surface allows the vinyl tile to be easily scored and cut after it is placed thereon.

Although the present invention has been described with reference to particular embodiments, it will be apparent to those skilled in the art that variations and modifications can be substituted therefor without departing from the principles and spirit of the invention.

I claim:

1. A vinyl tile spacing gauge and cutter for measuring and scoring of an edge flooring tile to be installed in a space defined between the outer edge of a central array of tiles installed on a floor and an adjacent wall, comprising:

a base larger than said tile and having a base edge;

a heated plate surface on said base, said surface having a measurement grid delineated thereon;

first and second extendable measuring arms extending from said base when said base edge is aligned with the outer edge of said array of floor tiles, said measuring arms extending over to contact said wall, each of said measuring arms further including a scale thereon in the same measurement units as the measurement grid on said heated plate surface; and scoring means adjustable in location disposed above said heated plate surface to score a tile placed thereunder on said heated plate surface, said scoring means being operable in parallel relationship to said base edge and adjustable to various distances away from said base edge, said vinyl tile once heated on said heated plate surface and scored by said scoring means to be broken along said scored line for insertion in said space between said outer edge of said central array of tiles on said floor and said wall.

2. The device of claim 1 wherein said first and second measuring arms are independently adjustable from one another to be used in situations where said wall is not in parallel relationship to the outer edge of said centrally installed floor tiles and said tile to be cut is positioned on said heated plate surface aligned with said measurement grid at a position under said scoring means corresponding to the measurements observed on said first and second measuring arms for said scoring means to be operated to cut into said tile at an angle to said tile, said scored tile when snapped to fit into said measured space defined between the outer edge of said central floor tiles and said wall.

* * * * *